US011491500B2

(12) United States Patent
Alsdorf et al.

(10) Patent No.: US 11,491,500 B2
(45) Date of Patent: Nov. 8, 2022

(54) PORTABLE CHEMICAL DISPENSER AND METHOD OF USING SAME

(71) Applicant: Delaware Capital Formation, Inc., Wilmington, DE (US)

(72) Inventors: Zach E. Alsdorf, Batavia, OH (US); Jason R. Brooks, Batavia, OH (US); Mark Dalhart, Mason, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 5 days.

(21) Appl. No.: 17/062,880

(22) Filed: Oct. 5, 2020

(65) Prior Publication Data

US 2021/0107019 A1 Apr. 15, 2021

Related U.S. Application Data

(60) Provisional application No. 62/913,947, filed on Oct. 11, 2019.

(51) Int. Cl.
*B05B 7/30* (2006.01)
*B05B 7/04* (2006.01)

(52) U.S. Cl.
CPC ..... *B05B 7/30* (2013.01); *B05B 7/0408* (2013.01)

(58) Field of Classification Search
CPC ..... B05B 7/30; B05B 7/0408; B05B 12/1409; B05B 15/63; B05B 7/2472; B05B 7/2443; B01F 25/31231; B01F 25/31243; B01F 25/316; B67D 7/0277; B67D 7/0288; B67D 7/741; B67D 7/423
See application file for complete search history.

(56) References Cited

U.S. PATENT DOCUMENTS 3,032,275 A * 5/1962 Schneider ..... B05B 7/30 239/592
3,053,457 A * 9/1962 Trumbull ..... B29B 7/7442 606/93
3,291,395 A 12/1966 Sharp
(Continued)

FOREIGN PATENT DOCUMENTS

ES 2242457 A1 11/2005
WO 9219530 A2 11/1992
(Continued)

OTHER PUBLICATIONS

European Patent Office, Extended European Search Report in EP Application No. 20201167.2, dated Mar. 12, 2021.

*Primary Examiner* — Vishal Pancholi
(74) *Attorney, Agent, or Firm* — Wood Herron & Evans LLP

(57) ABSTRACT

A portable chemical dispenser for dispensing a chemical with a diluent includes a valve housing having a valve with an opened position and a closed position, an eductor housing coupled to the valve housing and including one or more eductors, and a nozzle coupled to the eductor housing and configured to direct the flow of a chemical solution to a receptacle, wherein the joint between the valve housing and the eductor housing permits relative rotations between the two housings. The portable chemical dispenser may also be devoid of metering elements that control the dosing of the chemical. A method of using the portable chemical dispenser is also disclosed.

17 Claims, 15 Drawing Sheets

(56) References Cited

U.S. PATENT DOCUMENTS 3,940,069 A * 2/1976 Gunzel, Jr. ..... B05B 7/2443 239/394
3,964,689 A * 6/1976 Horvath, Jr. ..... B05B 7/2443 239/432
4,878,619 A * 11/1989 Norman ..... B05B 7/2443 239/335
5,064,123 A * 11/1991 Aiello ..... B05B 1/3053 239/128
5,123,449 A 6/1992 Nowicki
5,165,578 A 11/1992 Laible
5,351,875 A 10/1994 Rhine et al.
5,682,930 A 11/1997 Crossdale
5,996,907 A 12/1999 Toetschinger et al.
6,158,673 A 12/2000 Toetschinger et al.
6,182,911 B1 2/2001 Hanks et al.
6,450,374 B1 9/2002 Lohr
6,499,872 B2 12/2002 Sand
6,619,318 B2 9/2003 Dalhart et al.
6,655,401 B2 12/2003 Sand et al.
6,708,901 B2 3/2004 Hubmann et al.
6,766,831 B2 7/2004 Oliver
6,860,295 B2 3/2005 Lohr et al.
6,880,191 B2 4/2005 Bristor
6,988,675 B2 1/2006 Hubmann et al.
7,025,289 B2 4/2006 Hubmann et al.
7,086,610 B2 8/2006 Hubmann et al.
7,136,698 B2 11/2006 Phipps et al.
7,237,728 B1 7/2007 Laible
7,296,761 B1 11/2007 Laible
7,331,488 B2 2/2008 Naslund et al.
7,341,206 B2 3/2008 Hubmann et al.
7,341,207 B2 3/2008 Hubmann
7,370,813 B2 5/2008 Hubmann et al.
7,487,795 B2 2/2009 Sand
7,654,421 B2 2/2010 Chan et al.
7,784,715 B2 8/2010 Kress
7,850,095 B2 12/2010 Hubmann et al.
7,854,354 B2 12/2010 Laible
7,954,507 B2 6/2011 Boticki et al.
7,963,304 B2 6/2011 Bertucci et al.
3,016,212 A1 9/2011 Hubmann et al.
8,069,878 B2 12/2011 Laible
8,109,448 B2 2/2012 Giles
8,177,143 B2 5/2012 Laible
8,186,383 B2 5/2012 Schiller et al.
8,336,569 B2 12/2012 Lohr et al.
8,398,003 B2 3/2013 Hubmann et al.
8,584,716 B2 11/2013 Bertucci et al.
8,622,320 B2 1/2014 Plantz et al.
8,636,031 B2 1/2014 Schiller et al.
8,668,117 B2 3/2014 Crossdale et al.
8,726,939 B2 5/2014 Laible
8,870,094 B2 10/2014 Hubmann et al.
8,998,111 B2 4/2015 Sun
9,061,293 B2 6/2015 Beaulieu
9,174,179 B2 11/2015 Bertucci et al.
9,199,256 B2 * 12/2015 Jia ..... B05B 7/0408
9,227,212 B2 1/2016 Crossdale et al.
9,302,283 B2 4/2016 Plantz et al.
9,387,499 B2 7/2016 Sun
9,480,995 B2 11/2016 Hubmann et al.
9,498,086 B2 11/2016 Waggoner et al.
9,561,481 B2 2/2017 Schlueter et al.
9,616,441 B2 4/2017 Hubmann et al.
9,623,385 B2 4/2017 Krause et al.
9,625,299 B2 4/2017 Holden et al.
9,732,862 B2 8/2017 Schiller et al.
9,766,636 B2 9/2017 Jones et al.
9,808,773 B2 11/2017 Schlueter et al.
9,809,443 B2 11/2017 Bertucci et al.
10,007,275 B2 6/2018 Uhlhorn et al.
10,022,739 B2 7/2018 Crossdale et al.
10,328,398 B2 6/2019 Hubmann et al.
10,414,644 B1 9/2019 Laible
10,414,645 B1 9/2019 Laible
10,452,082 B2 10/2019 Bertucci et al.
2002/0092925 A1 * 7/2002 Hubmann ..... B01F 33/5011 239/525
2005/0013763 A1 1/2005 Bober et al.
2006/0097073 A1 * 5/2006 Dodd ..... B05B 7/1209 239/581.1
2007/0044820 A1 3/2007 Chan et al.
2008/0054098 A1 * 3/2008 Dodd ..... B05B 7/2443 239/310
2008/0078847 A1 4/2008 Lai
2008/0197214 A1 8/2008 Hubmann
2009/0108103 A1 4/2009 LaMantia
2009/0324746 A1 12/2009 Bober et al.
2010/0213220 A1 8/2010 Laible
2012/0168532 A1 7/2012 Giles
2012/0279912 A1 11/2012 McCurdy et al.
2013/0193226 A1 * 8/2013 Uschold ..... B05B 7/0408 239/407
2015/0157992 A1 6/2015 Boticki et al.
2015/0202580 A1 7/2015 McCurdy et al.
2016/0051947 A1 2/2016 Bertucci et al.
2016/0228890 A1 8/2016 Votteler et al.
2017/0216785 A1 8/2017 Krause et al.
2017/0232406 A1 8/2017 Waggoner et al.
2017/0296988 A1 10/2017 Waggoner et al.
2018/0094734 A1 4/2018 Schiller et al.
2018/0250694 A1 9/2018 Mcdonnell et al.
2018/0373273 A1 12/2018 Uhlhorn et al.
2019/0015859 A1 1/2019 Crossdale et al.
2019/0134575 A1 5/2019 Hubmann et al.
2019/0291065 A1 9/2019 Waggoner et al.

FOREIGN PATENT DOCUMENTS

WO 2006050061 A2 5/2006
WO 2011112711 A2 9/2011
WO 201901860 A1 1/2019
WO 201901939 A1 1/2019

* cited by examiner

PORTABLE CHEMICAL DISPENSER AND METHOD OF USING SAME

CROSS-REFERENCE TO RELATED APPLICATION

This application claims the benefit of and priority to U.S. Provisional Application No. 62/913,947 filed Oct. 11, 2019, the disclosure of which is incorporated by reference herein in its entirety.

TECHNICAL FIELD

This invention generally relates to an improved portable chemical dispenser for dispensing one or more chemicals, and more particularly to a portable chemical dispenser usable with multiple chemical sources across an application platform, such as a janitorial platform, and to a method of using such a portable chemical dispenser.

BACKGROUND

The dispensing of liquid chemical products from one or more chemical sources or reservoirs is a common requirement of many industries, such as the laundry, textile, warewash, healthcare, janitorial services and food processing industries. In the janitorial services industry, for example, many applications require aqueous solutions with various chemical agents for cleaning and sanitizing purposes. Chemical dispensing systems have been developed to deliver chemical products or chemical solutions for such applications. By way of example, many chemical dispensing systems used in janitorial applications rely on eductors for drawing chemical products into a diluent stream to produce a chemical solution containing the chemical product at a desired dilution ratio.

Eductors are devices that pass a liquid through a choke to generate the Venturi effect. The suction generated by the Venturi effect is used to draw another liquid into the eductor. For example, water running through the eductor may cause a chemical product to be drawn into the eductor, where it mixes with the water and is subsequently discharged as a dilute chemical solution. Eductors are considered attractive because they do not require external power to mix the chemical products with a diluent source (in contrast to, for example, a pump). Instead, the energy of the diluent stream is used to "pump" the chemical product into the diluent stream. Eductors are often used to mix chemical products with water in dispensing systems to produce small batches of chemical solutions for use in industrial applications. These batches of chemical solutions may be discharged into various point-of-use receptacles for use in a desired manner. By way of example, in janitorial applications chemical solutions may be discharged into various cleaning receptacles, such as spray bottles or mop buckets. To this end, some chemical dispensers may have a low-flow setting for spray bottle dispensing and a high-flow setting for bucket or large receptacle dispensing.

In some janitorial applications, the chemical dispensing system includes a relatively small, portable, eductor-based dispenser operatively coupled to a diluent source (e.g., a water source) and also operatively coupled to a reservoir of chemical. The reservoir of chemical may be a relatively small (e.g., one gallon), portable container of chemical that is coupled to the chemical dispenser via a length of tubing that allows the chemical to be drawn into the chemical dispenser with the movement of diluent through the eductor.

Janitorial applications typically include the dispensing a multiple chemicals (e.g., cleaning agent, sanitizing agent, etc.) into different receptables. Additionally, the dilution ratio of the chemical with diluent varies depending on the particular chemical that is being dispensed. The dilution ratio is typically controlled by a metering tip associated with the chemical dispenser and ranges anywhere between about 10:1 to about 128:1 (e.g., about 64:1). Thus, a first cleaning agent may be diluted at a first ratio, a second cleaning agent may be diluted at a second ratio; a first sanitizing agent may be diluted at a third ratio, etc. all at different dilution ratios. For a given eductor size and construction, and thus a fixed vacuum potential from the eductor, the amount of chemical being drawn into the eductor may be varied by positioning a metering tip in the chemical flow path. The metering tip may be selected to provide the desired dilution ratio for the resulting chemical solution.

As a result, the chemical dispenser used to dispense a particular chemical becomes specific to that chemical and generally cannot be used to dispense other desired chemicals in janitorial applications. In other words, each chemical used in janitorial applications typically has its own chemical dispenser for dispensing that chemical at the recommended dilution ratio. Such an arrangement is inefficient and increases the cost to janitorial service providers. Accordingly, there is a need for a small, low-cost portable chemical dispenser that is capable of dispensing multiple chemicals across the janitorial platform and at different dilution ratios in accordance with the recommended dosing.

SUMMARY

A portable chemical dispenser for dispensing a chemical with a diluent is disclosed. The portable chemical dispenser includes a valve housing having a diluent valve with an opened position and a closed position, wherein diluent is configured to flow through the portable chemical dispenser when the diluent valve is in the opened position and diluent is prevented from flowing through the portable chemical dispenser when the diluent valve is in the closed position. The portable chemical dispenser further includes an eductor housing coupled to the valve housing and including one or more eductors, wherein the eductor housing includes a chemical inlet port configured to be coupled to a chemical source storing the chemical, and a nozzle coupled to the eductor housing and configured to direct the flow of a chemical solution to a receptacle. The joint between the valve housing and the eductor housing permits relative rotations between the two housings. The portable chemical dispenser may also be devoid of metering elements that control the dosing of the chemical with the diluent.

The eductor housing may include a plurality of eductors and rotations of the valve housing relative to the eductor housing may place the diluent flow in communication with different eductors in the eductor housing when the diluent valve is in the opened position. In one embodiment, for example, the eductor housing includes first and second eductors and the valve housing is rotatable relative to the eductor housing between a first position wherein the diluent is configured to be in fluid communication with a first eductor, and a second position wherein the diluent is configured to be in fluid communication with the second eductor. In one embodiment, the valve housing may include an actuator, wherein the actuator is in a first position in the first position of the valve housing and the actuator is in a second position in the second position of the valve housing. The first and second positions of the valve housing relative to the eductor housing may be offset by 180 degrees.

A method of dispensing a plurality of chemicals from respective chemical sources using a diluent including providing a portable chemical dispenser is disclosed. The portable chemical dispenser may be devoid of any metering elements that control the dosing of the chemical with the diluent. The method may include connecting the portable chemical dispenser with a first chemical source storing a first chemical; dispensing the first chemical using the portable chemical dispenser; disconnecting the portable chemical dispenser from the first chemical source; connecting the portable chemical dispenser with a second chemical source storing a second chemical; and dispensing the second chemical using the portable chemical dispenser. The first and second chemicals may be dispensed at the same or different dilution ratios. Additionally, the first and second chemicals may be dispensed at two different flow rates by the portable chemical dispenser.

In one embodiment, connecting the portable chemical dispenser with the first chemical source further includes connecting the portable chemical dispenser with a first cartridge associated with the first chemical source, wherein the first cartridge contains metering elements that control the dosing of the first chemical with the diluent. The first cartridge may be separated from the first chemical source and operatively coupled to the first chemical source by a tube, preferably a single tube. In one embodiment, the first cartridge may be positioned within a cap or within the confines of the first chemical source. In one embodiment, the portable chemical dispenser may be clipped to the first chemical source.

In one embodiment, connecting the portable chemical dispenser with the second chemical source includes connecting the portable chemical dispenser with a second cartridge associated with the second chemical source, wherein the second cartridge contains metering elements that control the dosing of the second chemical with the diluent. The second cartridge may be separated from the second chemical source and operatively coupled to the second chemical source by tubing. In one embodiment, the second cartridge may be positioned within a cap or within the confines of the second chemical source. In one embodiment, the portable chemical dispenser may be clipped to the second chemical source.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
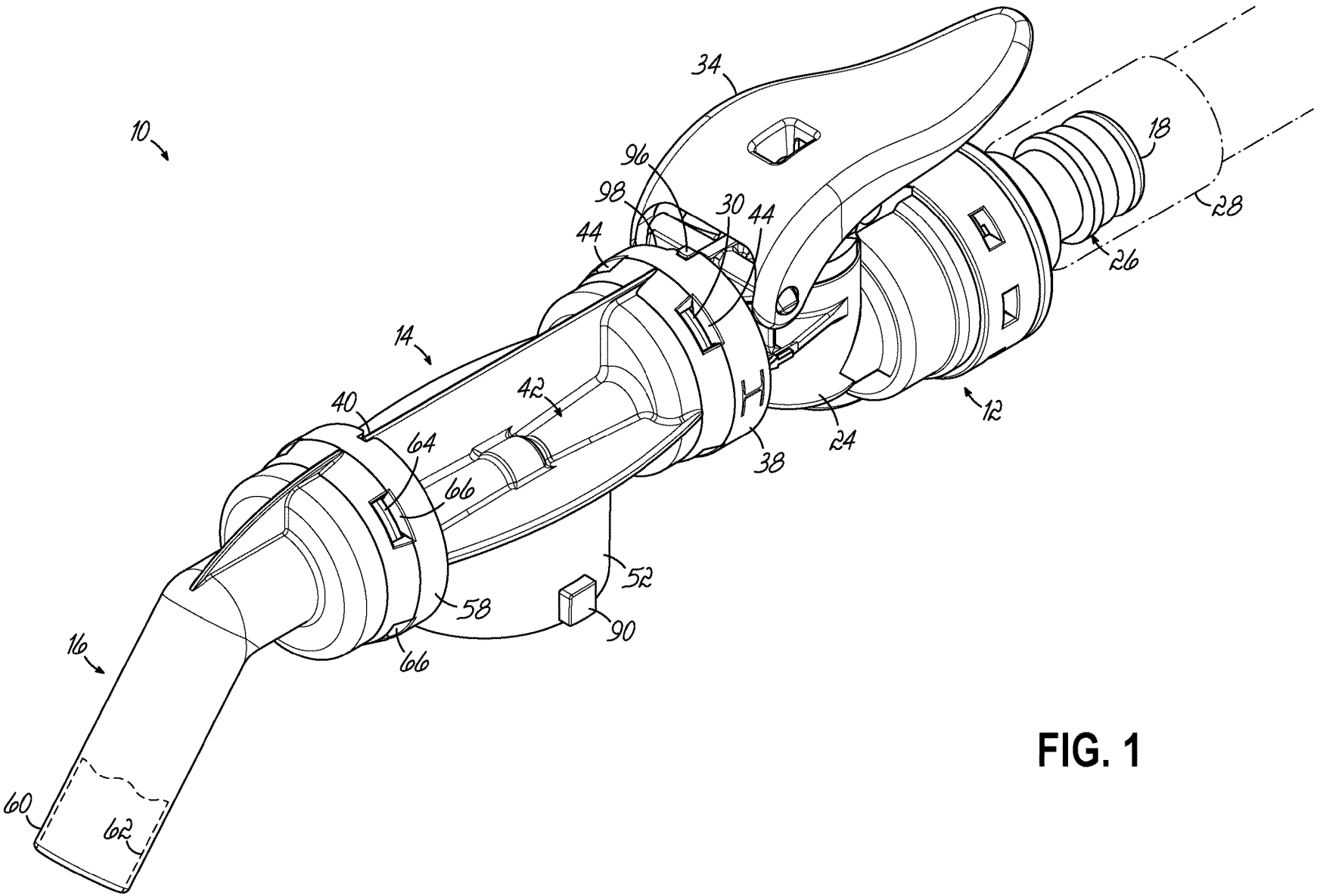
FIG. 1 illustrates a perspective view of a portable chemical dispenser in accordance with a first embodiment of the invention.

FIG. 1 illustrates a portable chemical dispenser 10 in accordance with a first embodiment of the invention. As illustrated in this figure and the following figures, the portable chemical dispenser 10 generally includes a valve housing 12 at a first end of the portable chemical dispenser 10, an intermediate educator housing 14, and a nozzle 16 at a second end of the portable chemical dispenser 10. The valve housing 12, in addition to providing the diluent to the portable chemical dispenser 10, may operate as a "handle" for the portable chemical dispenser 10, such as by an operator. As such, the term valve housing and handle may be used interchangeably herein. The eductor housing 14 includes one or more eductors that provide for the introduction of a chemical into the portable chemical dispenser 10. Lastly, the nozzle 16 provides a flow path for delivering the chemical solution (i.e., chemical and diluent mixed together) to a desired receptacle, such as a spray bottle, mop bucket or the like. A description of each of these components will now be provided.

The valve housing 12 includes a first end 18 configured to be coupled to a diluent source 20, a second end 22 configured to be coupled to the eductor housing 14, and a diluent valve 24 disposed between the first and second ends 18, 22. The first end 18 may include a fluid connector 26 configured to couple to a fluid conduit 28 that supplies the diluent from diluent source 20 under pressure. For example, the diluent source 20 may be a municipal water supply. In one embodiment, the fluid connector 26 may be designed to rotate or swivel relative to the remainder of the valve housing 12 to provide a greater level of movement to the fluid conduit 28 and/or portable chemical dispenser 10 during use.

The second end 22 of the valve housing 12 includes a snap-fit connection for coupling to the eductor housing 14.

By way of example and without limitation, in an exemplary embodiment the snap-fit connection may include one or more detents 30 (e.g., an annular rib) configured to cooperate with one or more features on the eductor housing 14 for connecting the valve housing 12 and eductor housing 14 together. The second end 22 of the valve housing 12 may also include one or more seals for connecting to the eductor housing 14 in a fluid-tight manner.

The diluent valve 24 of the valve housing 12 includes an opened position and a closed position. In the opened position of the diluent valve 24, diluent (e.g., water) may pass through the valve housing 12 and flow into the eductor housing 14 via an off-center outlet 32 on the downstream side of the diluent valve 24 (see FIGS. 4B and 5B), and in the closed position of the diluent valve 24, diluent is not permitted to flow through the valve housing 12. The diluent valve 24 may include an actuator 34 for moving the diluent valve 24 between the opened and closed positions. In an exemplary embodiment, the actuator 34 may include a pivotable lever having a first position when the diluent valve 24 is in the closed position and a second position when the diluent valve 24 is in the opened position. When chemical dispensing is desired, an operator may press the lever to thereby position the diluent valve 24 in the opened position and thereby allow diluent to flow through the valve housing 12 and into the eductor housing 14. The diluent valve 24 may be spring biased such that upon release of the lever, the diluent valve 24 returns to its normally closed position and diluent is not permitted to flow through the valve housing 12. Diluent valve 24 is of the type that is generally known in the art, and thus a detailed description of the construction and operation of the diluent valve 24 will be omitted for sake of brevity. In one embodiment, the diluent valve 24 may include a latch mechanism for maintaining the diluent valve 24 in the opened position one positioned in the opened position by an operator. For example, the actuator 34 may include a latch mechanism for maintaining the lever in a depressed state. Although not shown, the latch mechanism may include opposing fingers configured to selectively engage one another, such as by a button or slide switch, to keep the lever in the depressed state (and the diluent valve 24 in the opened position). Upon release of the latch mechanism, the actuator 20 will move to the closed position.

The eductor housing 16 includes a first end 38 configured to be coupled to the valve housing 12, a second end 40 configured to be coupled to the nozzle 16, and one or more eductors 42 disposed between the first and second ends 38, 40. In an exemplary embodiment, the eductor housing 16 may include two eductors 42*a*, 42*b*, however the educator housing 14 may include more or less eductors. As discussed above, the first end 38 of the eductor housing 14 is configured to couple to the second end 22 of the valve housing 12 through a snap-fit connection. To this end, the second end 22 of the valve housing 12 includes one or more detents 30 and the first end 38 of the eductor housing 14 is configured to include one or more catches 44 (e.g., in the form of triangular-shaped ramps). When the ends 22, 38 are brought together, the one or more detents 30 engage the one or more catches 44 and cause the one or more detents 30 to elastically flex or deform so as to allow the one or more detents 30 to pass by or beyond the one or more catches 44. Once the one or more detents 30 pass by the one or more catches 44, the detents 30 spring back to a non-deformed position or less deformed position and thereby lock the one or more detents 30 behind the one or more catches 44 to secure the valve housing 12 and the educator housing 14 together. This snap-fit connection prevents any significant relative axial movements between the eductor housing 14 and the valve housing 12.

In one aspect of the invention, however, the snap-fit connection between the valve housing 12 and the eductor housing 14 is configured to permit relative rotations between the valve housing 12 and the eductor housing 14. Thus, while relative axial movements between the valve housing 12 and the eductor housing 14 along the longitudinal axis of the chemical dispenser 10 are prevented, relative rotational movements about the longitudinal axis of the portable chemical dispenser 10 are permitted. The purpose of this feature will be explained in more detail below. In any event, it should be recognized that through this snap-fit connection, the handle of the portable chemical dispenser 10 may rotate about the longitudinal axis of the dispenser 10 relative to the remainder portions of the portable chemical dispenser 10.

The second end 40 of the eductor housing 14 includes a snap-fit connection for coupling to the nozzle 16. By way of example and without limitation, in an exemplary embodiment the snap-fit connection may include one or more detents 64 (e.g., an annular rib) configured to cooperate with one or more features on the nozzle 16 for connecting the eductor housing 14 and nozzle 16 together. The second end 40 of the eductor housing 14 may also include one or more seals for connecting to the nozzle 16 in a fluid-tight manner.

The eductors 42*a*, 42*b* of the eductor housing 14 are of conventional design and include converging-diverging passages 46*a*, 46*b* having a throat or choke region. The throat region of each of the passages 46*a*, 46*b* includes respective openings 48*a*, 48*b* in communication with a chemical source 50 for introducing a chemical stored in the chemical source 50 into the diluent stream flowing through a select one of the eductors 42*a*, 42*b*. More particularly, the eductor housing 14 includes a chemical inlet port 52 depending from the eductor housing 14 adjacent the throat region to facilitate a connection to the chemical source 50. As illustrated in FIGS. 4A and 5A, the chemical inlet port 52 includes two passageways 54*a*, 54*b* corresponding to passageways 46*a*, 46*b* and in fluid communication with their respective passageways 46*a*, 46*b* via openings 48*a*, 48*b* (see FIGS. 4D and 5D). The connection between the chemical inlet port 52 and the chemical source 50 will be described in more detail below. Eductors of this type are generally well known in the art, and thus a further detailed discussion of the eductors 42*a*, 42*b* and their operation will be omitted for sake of brevity.

The nozzle 16 includes a first end 58 configured to be coupled to the eductor housing 14, a second end 60 configured to be in fluid communication with a receptacle, and a passageway 62 extending between the first and second ends 58, 60. As discussed above, the first end 58 of the nozzle 16 is configured to couple to the second end 40 of the eductor housing 14 through a snap-fit connection. To this end, the second end 40 of the eductor housing 14 includes one or more detents 64 and the first end 58 of the nozzle 16 is configured to include one or more catches 66 (e.g., in the form of triangular-shaped ramps). When the ends 40, 58 are brought together, the one or more detents 64 engage the one or more catches 66 and cause the one or more detents 64 to elastically flex or deform so as to allow the one or more detents 64 to pass by or beyond the one or more catches 66. Once the one or more detents 64 pass by the one or more catches 66, the detents 64 spring back to a non-deformed position or less deformed position and thereby lock the one or more detents 64 behind the one or more catches 66 to secure the educator housing 14 and the nozzle 16 together.

This snap-fit connection prevents any significant relative axial movements between the nozzle 16 and the eductor housing 14. Similar to the above, in one embodiment, the snap-fit connection between the eductor housing 14 and the nozzle 16 is configured to permit relative rotations between the eductor housing 14 and nozzle 16. Thus, while relative axial movements between the eductor housing 14 and nozzle 16 along the longitudinal axis of the portable chemical dispenser 10 are prevented, relative rotational movements about the longitudinal axis of the portable chemical dispenser 10 are permitted. This may facilitate improved dispensing of chemical solutions from the portable chemical dispenser 10. In an alternative embodiment, the educator housing 14 and the nozzle 16 may be rotationally fixed relative to each other. The nozzle 16 may include one or more clips (not shown) for securing the nozzle 16 to the receptacle in which the chemical solution is being dispensed. For example, the nozzle 16 may include a clip for securing the nozzle 16 to a bucket.

Figure 2:
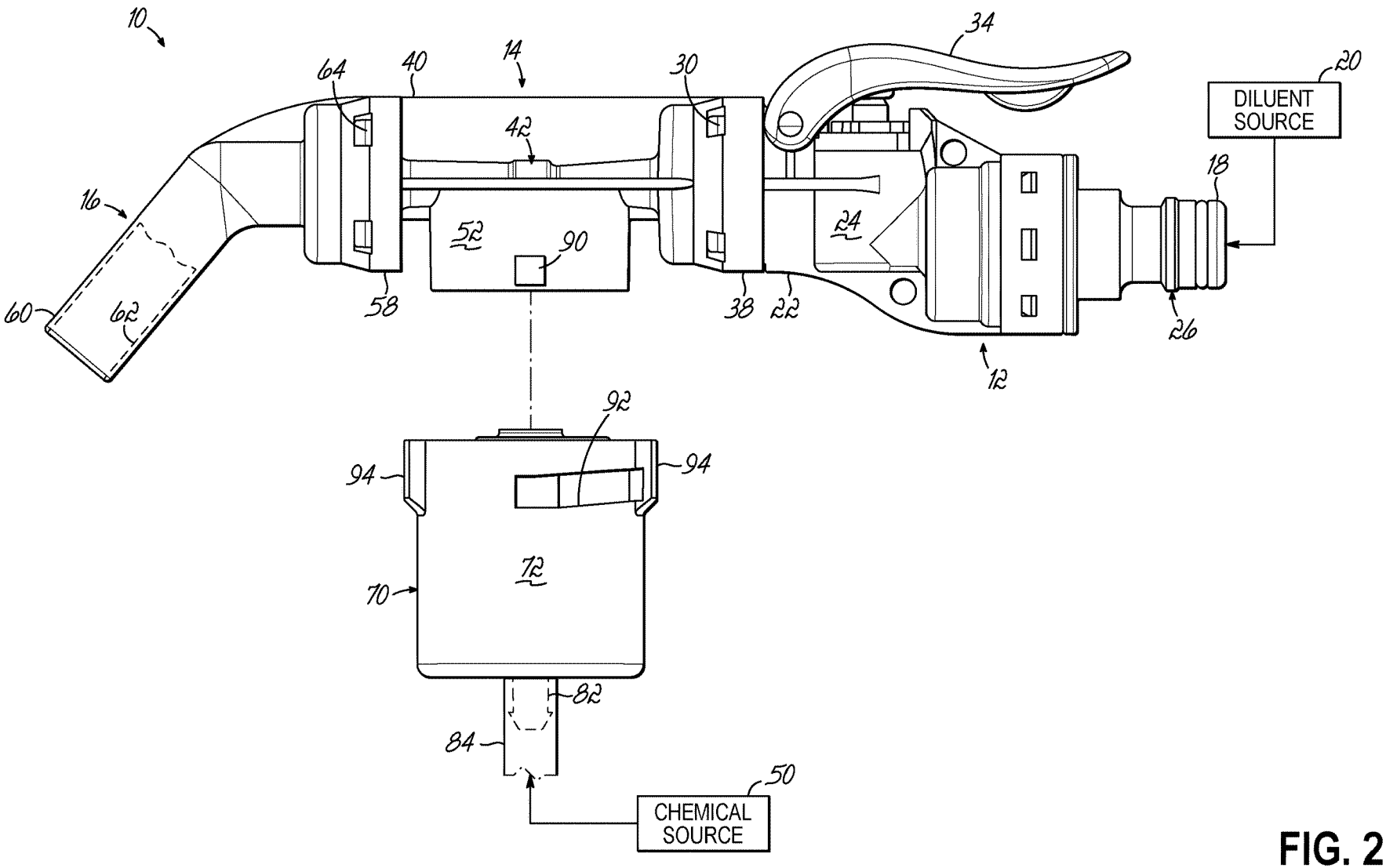
FIG. 2 illustrates the portable chemical dispenser of FIG. 1 with a cartridge associated with a chemical source.
Figure 3:
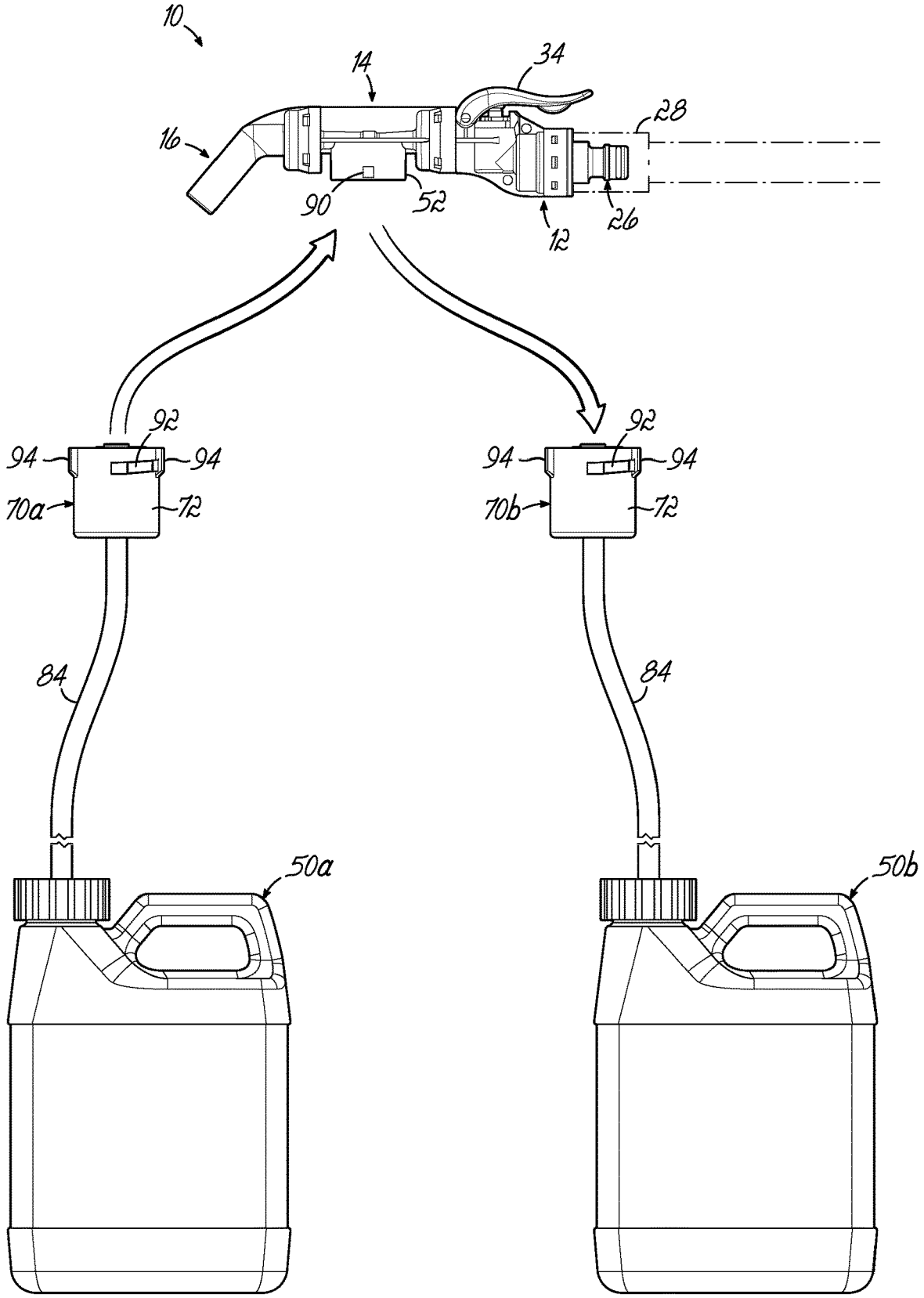
FIG. 3 illustrates the portable chemical dispenser of FIG. 1 being connectable to a plurality of chemical sources.

In one aspect of the invention and as illustrated in FIGS. 2 and 3, the portable chemical dispenser 10 is configured to be used for dispensing multiple chemicals from multiple chemical sources 50 and is not limited for use with one specific chemical or chemical source, as with prior portable chemical dispensers. By way of example, as illustrated in FIG. 3, the portable chemical dispenser 10 is configured to be operatively coupled to a first chemical source 50*a* for dispensing a first chemical and is further configured to be coupled to a second chemical source 50*b* for dispensing a second chemical. It should be recognized that the chemical dispenser 10 may be used to dispense additional chemicals from further chemical sources 50. For example, the chemical dispenser 10 may be configured to dispense most, if not all, of the chemicals used across an application platform, such as a janitorial platform. Thus, the portable chemical dispenser 10 may be used to dispense multiple chemicals even when the dilution ratios of the multiple chemicals are different from one another. The inability of prior chemical dispensers to accommodate different dilution ratios for different chemicals is a primary factor for why portable chemical dispensers were limited for use with a specific chemical or chemical source.

That limitation has been overcome in accordance with aspects of the present invention. More particularly, in accordance with aspects of the present invention, the metering elements that control the dilution ratio in a chemical solution have been physically separated from the portable chemical dispenser 10 and instead are associated with the particular chemical source 50. In this regard and in an exemplary embodiment, each chemical source 50 may include a cartridge 70 that includes various metering elements which control the amount of chemical that is drawn into the portable chemical dispenser 10 from the chemical source 50 when the chemical source 50 is operatively coupled to the portable chemical dispenser 10 (and subject to the Venturi effect). Thus, when a first chemical is to be dispensed, the portable chemical dispenser 10 may be coupled to a first cartridge 70*a* associated with the first chemical source 50*a*. The first cartridge 70*a* controls the amount of the first chemical being drawn into the portable chemical dispenser 10 for providing the desired dilution ratio for the first chemical. Subsequently, the portable chemical dispenser 10 may be disconnected from the first cartridge 70*a* and connected to a second cartridge 70*b* associated with the second chemical source 50*b*. The second cartridge 70*b* controls the amount of the second chemical being drawn into the portable chemical dispenser 10 for providing the desired dilution ratio for the second chemical. The portable chemical dispenser 10 may be disconnected from the second cartridge 70*b* and connected to further cartridges for dispensing additional chemicals at potentially different dilution ratios, as dictated by their respective cartridges 70.

By way of example and without limitation, in an exemplary embodiment the cartridge 70 may include a generally cylindrical housing 72 defining first and second passageways 74*a*, 74*b*. A first end 76 of the passageways 74*a*, 74*b* is configured to be in fluid communication with respective passageways 54*a*, 54*b* in the chemical inlet port 52 of the portable chemical dispenser 10 when the cartridge 70 is coupled thereto. A second end 78 of the passageways 74*a*, 74*b* is in fluid communication with a manifold 80 that is in turn open to a connector 82. The connector 82 is configured to receive a conduit line 84 (e.g., flexible tubing) operatively coupled to the chemical source 50. In an exemplary embodiment, each passageway 74*a*, 74*b* includes a metering tip region 86*a*, 86*b* for receiving a metering tip that is configured to dispense a specific amount of chemical when subject to operation of its associated eductor 42*a*, 42*b*. Metering tips of the type used herein are generally known in the art and a further description of the metering tips will not be provided. Each passageway 74*a*, 74*b* may also include a poppet valve 88 for closing off access to the chemical source 50 upon deactivation of its associated eductor 42*a*, 42*b* or disconnection of the cartridge 70 from the portable chemical dispenser 10. Poppet valves 88 of the type used herein are generally known in the art and a further description of the poppet valves will not be provided. Although not shown, the cartridge 70 may include a fastener, such as a hook or eyelet, for securing the cartridge 70 at a height above the chemical source 50, such as in a storage cabinet or the like. This would prevent chemical from the chemical source 50 from leaking out in the event that the poppet valves 88 in the cartridge would fail.

The cartridges 70 associated with the chemical sources 50 are configured to be easily and selectively connected/disconnected from the portable chemical dispenser 10. In an exemplary embodiment, a cartridge 70 may be coupled to the portable chemical dispenser 10, and more particularly to the chemical inlet port 52 through a bayonet connection. For example, the chemical inlet port 52 may include one or more detents 90 (e.g., two detents) and the cartridge 70 may include one or more slots 92. A first end of the one or more slots 92 includes a keyway 94 for allowing a respective detent 90 to pass into the one or more slots 92. Once the one or more detents 90 are positioned in the one or more slots 92, the cartridge 70 may be turned or rotated such that the one or more detents 90 traverse the one or more slots 92 until a second closed end of the one or more slots 92 is reached. The one or more slots 92 may be slightly angled so as to bring the cartridge 70 into tight engagement with the chemical inlet port 52, thereby forming a fluid-tight seal therebetween. To disconnect the cartridge 70 from the portable chemical dispenser 10, the cartridge 70 may be rotated in the opposite direction until the one or more detents 90 align with the one or more keyways 94, thereby allowing the cartridge 70 to move away from the portable chemical dispenser 10.

Operation of the portable chemical dispenser 10 will now be described in detail. When it is desired to dispense a first chemical, the portable chemical dispenser 10 may be coupled to the first chemical source 50*a* that holds a supply of the first chemical. In this regard, the cartridge 70*a* associated with the first chemical source 50*a* may be coupled to the chemical inlet port 52 of the portable chemical dispenser 10 through the bayonet connection. The portable chemical dispenser 10 may also be coupled to the diluent source 20. At this point, the portable chemical dispenser 10 is ready to dispense the first chemical.

As discussed above, the portable chemical dispenser 10 includes two eductors 42*a*, 42*b* that may have two different flow rates associated with the eductors 42*a*, 42*b* (e.g., high flow and low flow). Thus, the portable chemical dispenser 10 must be configured to dispense from a select one of the eductors 42*a*, 42*b* depending on, for example, the receptacle into which the chemical solution is being dispensed. In one aspect of the invention, the valve housing 12, which operates as a handle for the portable chemical dispenser 10 (and the term handle may be used interchangeably with the term valve housing) is rotatable relative to the remainder of the portable chemical dispenser 10 between a first position and a second position. In the first position, the outlet 32 of the valve housing 12 is in fluid communication with the first eductor 42*a* (e.g., high flow; 3 gallons per minute), and in the second position, the outlet 32 of the valve housing 12 is in fluid communication with the second eductor 42*b* (e.g., low flow; 1 gallon per minute). By way of example, in one embodiment the first and second positions may be offset by about 180 degrees. Thus, in the first position of the handle 12, the actuator 34 (e.g., lever) may be positioned on top of the portable chemical dispenser 10 such that pressing downwardly will move the diluent valve 24 to the opened position and allow diluent to pass into the first eductor 42*a*. In the second position of the handle 12, the actuator 34 may be positioned below the portable chemical dispenser 10 such that pulling upwardly will move the diluent valve 24 to the opened position and allow diluent to pass into the second educator 42*b*.

In one embodiment, the portable chemical dispenser 10 may include a rotational limit mechanism that limits the relative rotation between the valve housing 12 and the eductor housing 14. In this regard, the valve housing 12 may include a tab 96 and the eductor housing 14 may include a cutout or slot 98 which receives the tab when the valve housing 12 and eductor housing 14 are coupled together (FIG. 1). The tab 96 is configured to engage against a first end wall of the slot 98 when the handle 12 is in the first position (FIG. 4C) and configured to engage against a second end wall of the slot 98 when in the second position (FIG. 5C). The tab 96 is configured to traverse the slot 98 as the handle 12 is moved between the first and second positions.

Figure 4:
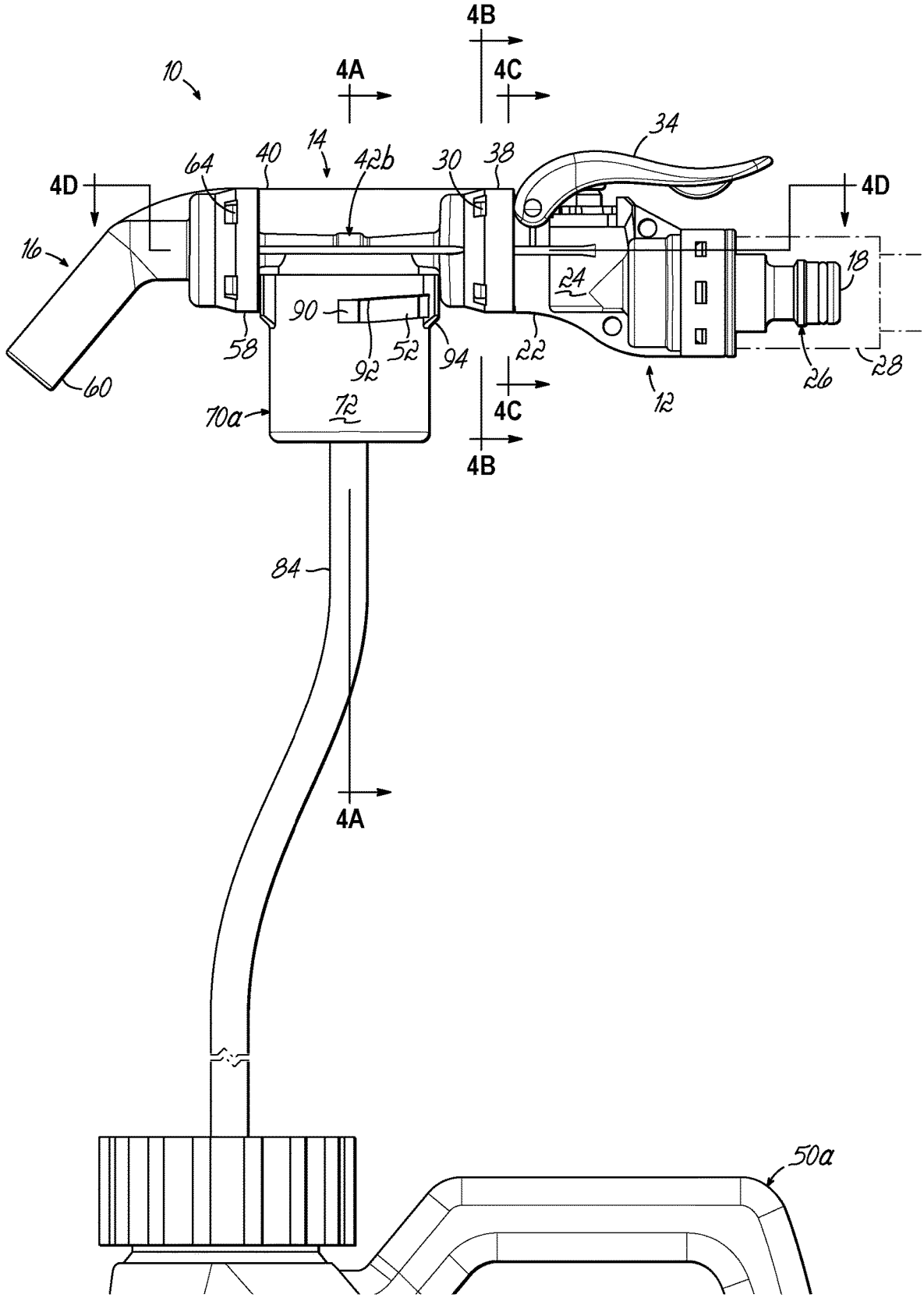
FIG. 4 illustrates the portable chemical dispenser of FIG. 1 coupled to a first chemical source and dispensing through a first eductor of the portable chemical dispenser.
Figure 4B:
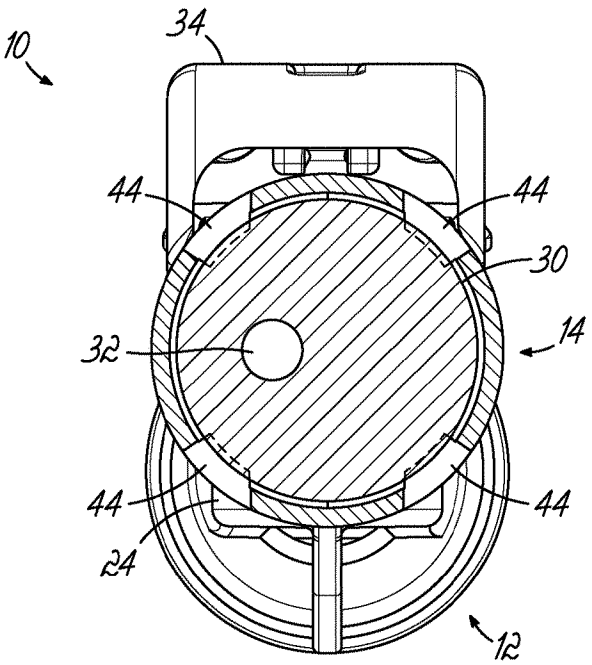
FIG. 4B is a cross-sectional view through the portable dispenser shown in FIG. 4 generally along line 4B-4B.
Figure 4A:
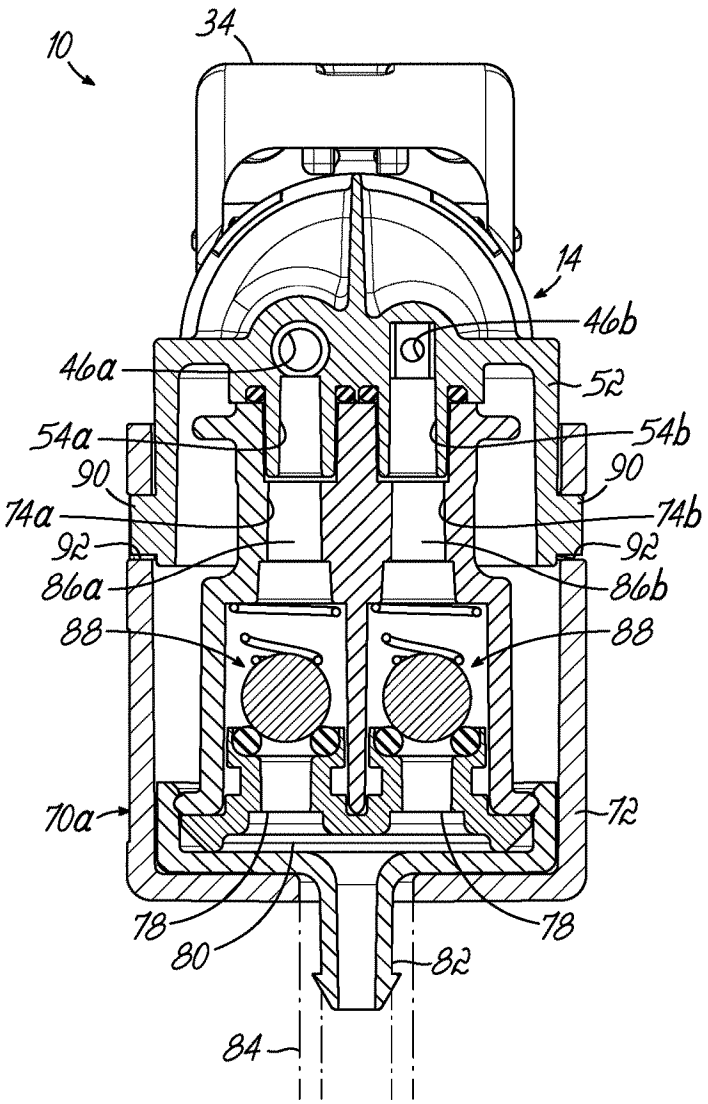
FIG. 4A is a cross-sectional view through the portable dispenser shown in FIG. 4 generally along line 4A-4A.
Figure 4D:
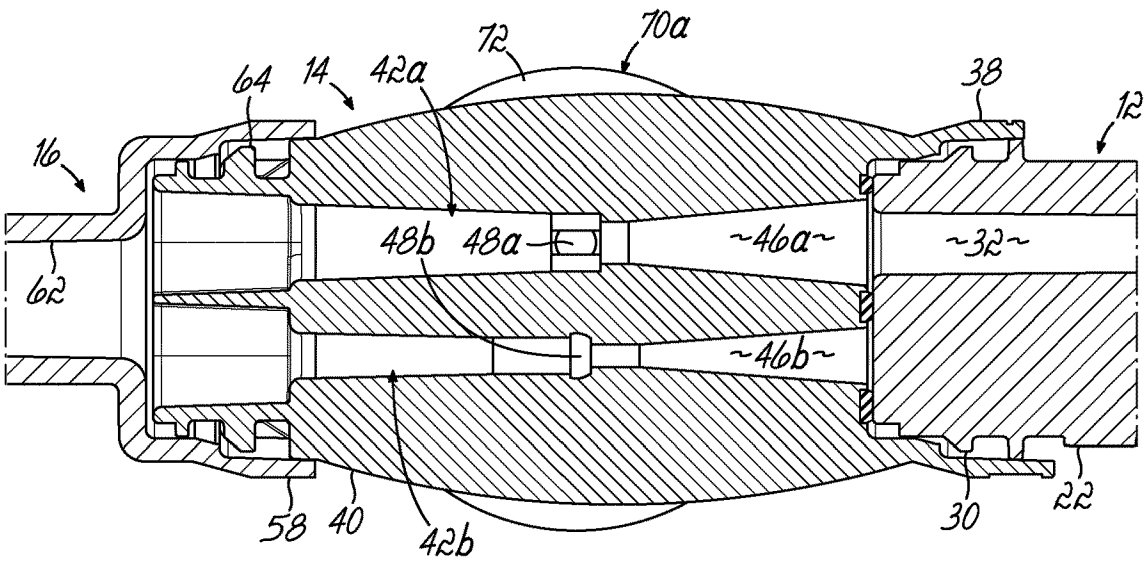
FIG. 4D is a partial cross-sectional view through the portable dispenser shown in FIG. 4 generally along line 4D-4D.
Figure 4C:
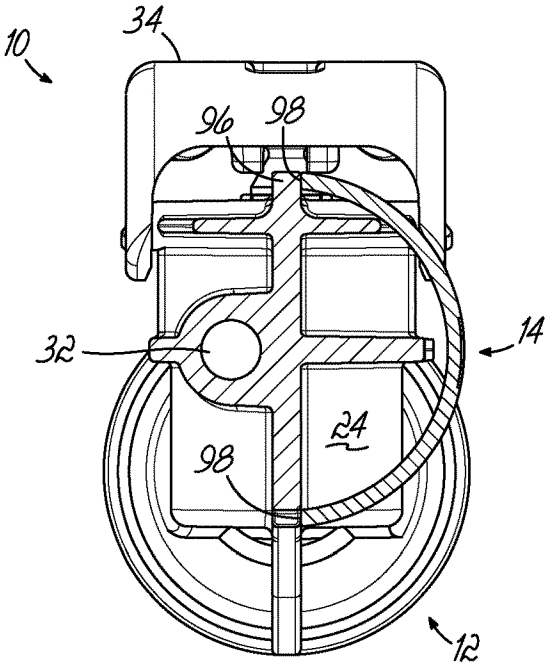
FIG. 4C is a cross-sectional view through the portable dispenser shown in FIG. 4 generally along line 4C-4C.

FIG. 4 illustrates the portable chemical dispenser 10 coupled to a first chemical source 50*a* via cartridge 70*a* and conduit line 84. In FIG. 4, the handle 12 is shown in the first position with the actuator 34 in an upright position (e.g., high flow). As illustrated in FIGS. 4A-4D, when the handle 12 is in the first position, the outlet 32 of the valve housing 12 is aligned with the first eductor 42*a* of the eductor housing 14. When an operator presses the lever 34, the diluent valve 24 is moved to the opened position and diluent flows through the valve housing 12, out of the outlet 32, and into the passageway 46*a* of eductor 42*a*. This diluent flow through eductor 42*a* creates a vacuum that causes the poppet valve 88 in passageway 74*a* in the cartridge 70*a* to open and allow chemical from the chemical source 50*a* to be drawn into the passageway 74*a* in the cartridge 70*a*, into the passageway 54*a* in the chemical inlet port 52, and into the eductor 42*a* via the opening 48*a*. The metering tip in the passageway 74*a* of cartridge 70*a* meters the amount of chemical that is drawn so as to arrive at the desired dilution ratio. Upon release of the actuator 34 by the operator, the diluent valve 24 moves to the closed position, the diluent flow through the eductor 42*a* ceases, and the poppet valve 88 in passageway 74*a* of the cartridge 70*a* closes.

Figure 5:
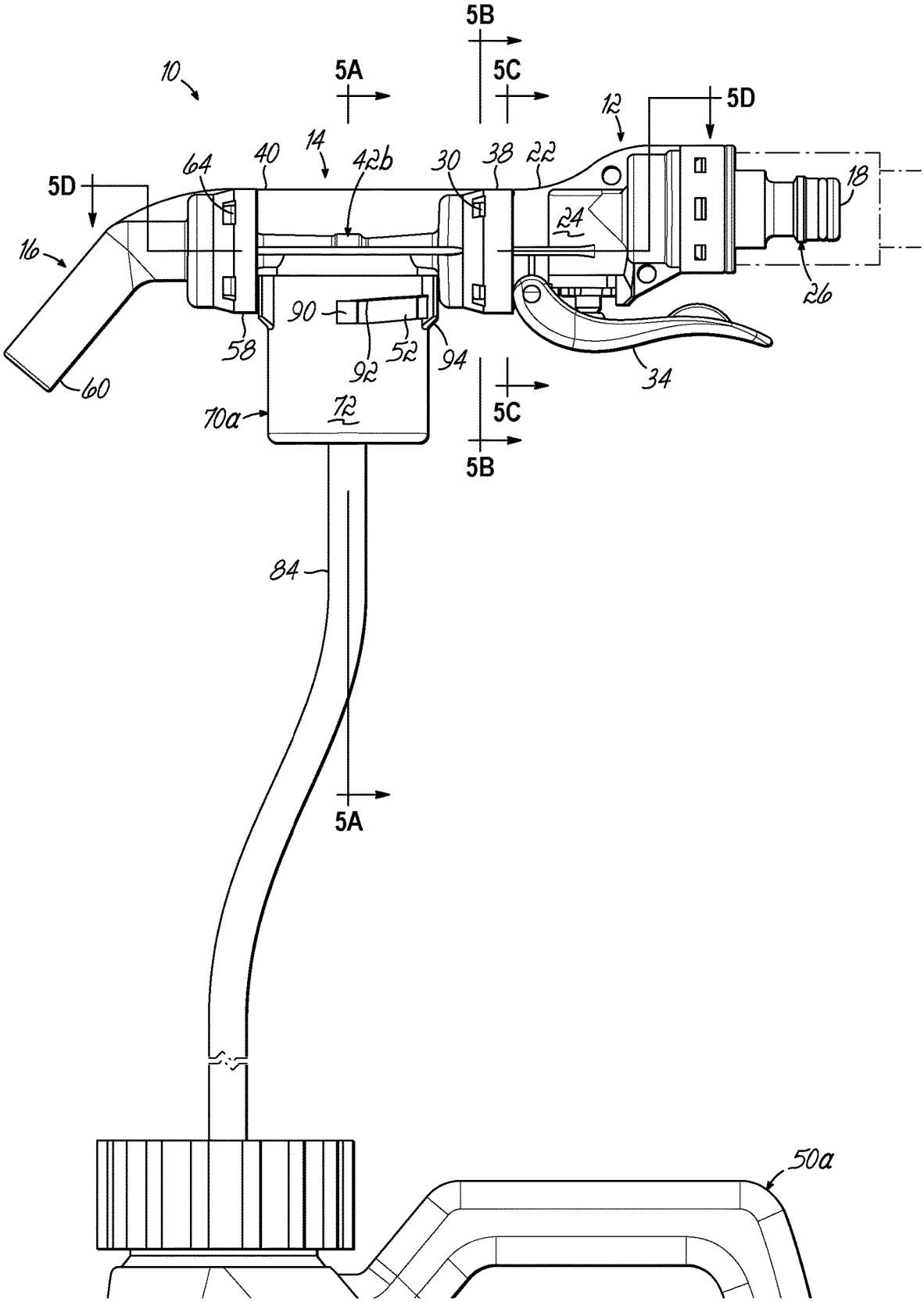
FIG. 5 illustrates the portable chemical dispenser of FIG. 1 coupled to a first chemical source and dispensing through a second eductor of the portable chemical dispenser.
Figure 5B:
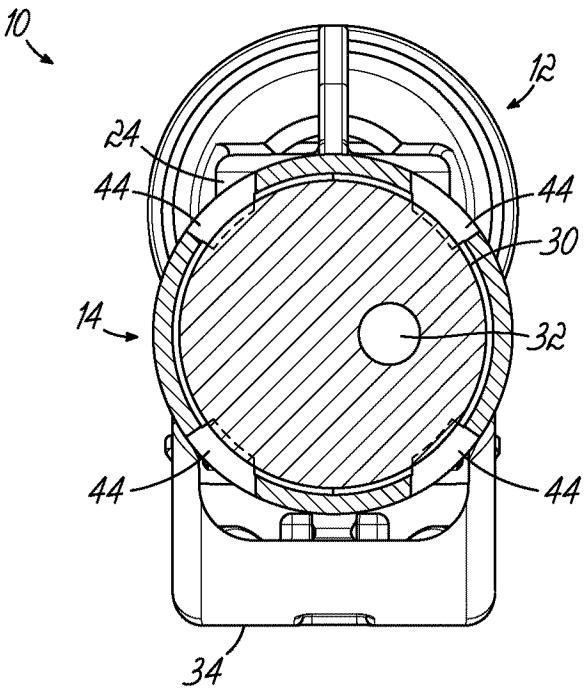
FIG. 5B is a cross-sectional view through the portable dispenser shown in FIG. 5 generally along line 5B-5B.
Figure 5A:
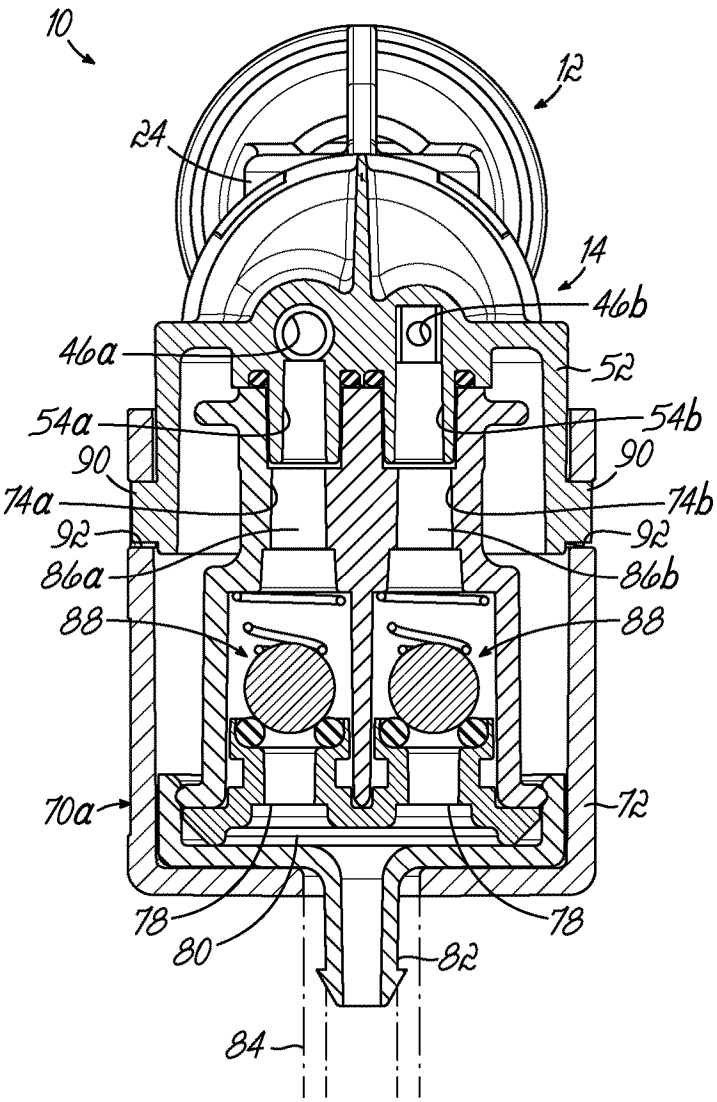
FIG. 5A is a cross-sectional view through the portable dispenser shown in FIG. 5 generally along line 5A-5A.
Figure 5D:
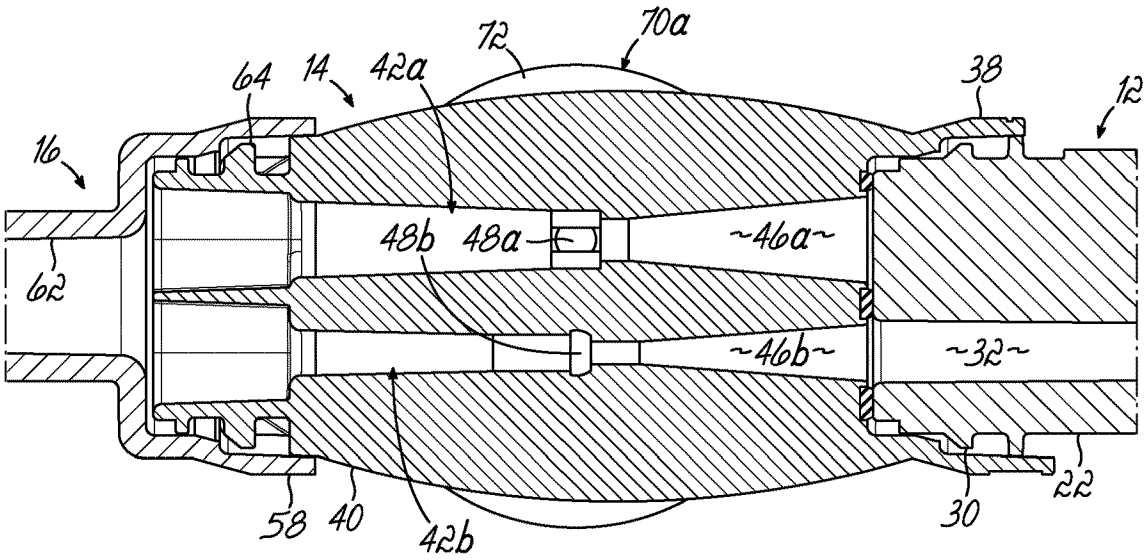
FIG. 5D is a partial cross-sectional view through the portable dispenser shown in FIG. 5 generally along line 5D-5D.
Figure 5C:
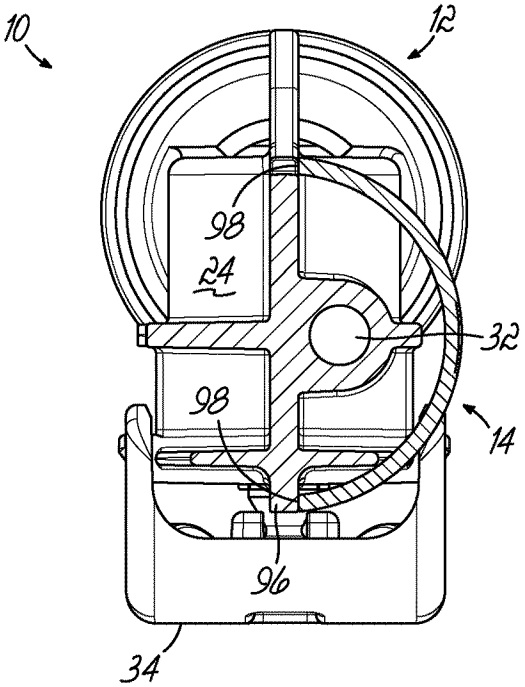
FIG. 5C is a cross-sectional view through the portable dispenser shown in FIG. 5 generally along line 5C-5C.

In a similar manner, FIG. 5 illustrates the portable chemical dispenser 10 coupled to the first chemical source 50*a* via cartridge 70*a* and conduit line 84 but with the handle 12 being shown in the second position with the actuator 34 in a downturned position (e.g., low flow). As illustrated in FIGS. 5A-5D, when the handle 12 is in the second position, the outlet 32 of the valve housing 12 is aligned with the second eductor 42*b* of the eductor housing 14. When an operator presses the lever 34, the diluent valve 24 is moved to the opened position and diluent flows through the valve housing 12, out of the outlet 32, and into the passageway 46*b* of eductor 42*b*. This diluent flow through eductor 42*b* creates a vacuum that causes the poppet valve 88 in passageway 74*b* in the cartridge 70*a* to open and allow chemical from the chemical source 50*a* to be drawn into the passageway 74*b* in the cartridge 70*a*, into the passageway 54*b* in the chemical inlet port 52, and into the eductor 42*b* via the opening 48*b*. The metering tip in the passageway 74*b* of cartridge 70*a* meters the amount of chemical that is drawn so as to arrive at the desired dilution ratio. Upon release of the actuator 34 by the operator, the diluent valve 24 moves to the closed position, the diluent flow through the educator 42*b* ceases and the poppet valve 88 in passageway 74*b* of the cartridge 70*b* closes.

Upon completion of dispensing the first chemical from the first chemical source 50*a*, the portable chemical dispenser 10 may be disconnected from the first chemical source 50*a* by disengaging the cartridge 70*a* from the chemical inlet port 52 of the portable chemical dispenser 10 (e.g., the bayonet connection). When it is desired to dispense a second chemical from a second chemical source 50*b*, the cartridge 70*b* associated with the second chemical source 50*b* may be connected to the chemical inlet port 52 of the portable chemical dispenser 10 via the bayonet connection as described above. The particular eductor 42*a*, 42*b* may then be selected (e.g., high flow rate or low flow rate) for dispensing the second chemical by moving the handle 12 to one of the first or second positions (see FIG. 4C or 5C). The operator may then engage the actuator 34 (e.g., press/pull the lever) to open the diluent valve 24 and dispense the chemical solution to a receptacle. The metering tips in the cartridge 70*b* set the dilution ratio for the second chemical, which may be different from the dilution ratio for the first chemical. This process may be repeated for additional chemicals being dispensed by the portable chemical dispenser 10.

The portable chemical dispenser 10 described above provides a number of advantages over current portable chemical dispensers. First, the portable chemical dispenser 10 may be used to dispense multiple chemicals from different chemical sources 50, with each chemical potentially having a different dilution ratio. This is primarily achieved by associating the metering element(s) responsible for metering the dosing of the chemical in the diluent flow with the chemical source instead of the portable chemical dispenser itself, as is done in conventional portable chemical dispensers. More particularly, each chemical source includes a dedicated cartridge configured to be easily and selectively coupled to the portable chemical dispenser. The cartridge contains the metering elements that control the dosing of the chemical and the dilution ratio of the resulting chemical solution. Second, the portable chemical dispenser 10 includes a plurality of eductors 42, and the handle 12 of the portable chemical dispenser 10 is rotatable about the longitudinal axis of the portable chemical dispenser 10 as a means to select one of the plurality of eductors 42. Thus, the portable chemical dispenser 10 may be configured to provide a high-flow dispensing process and a low-flow dispensing process.

Figure 6:
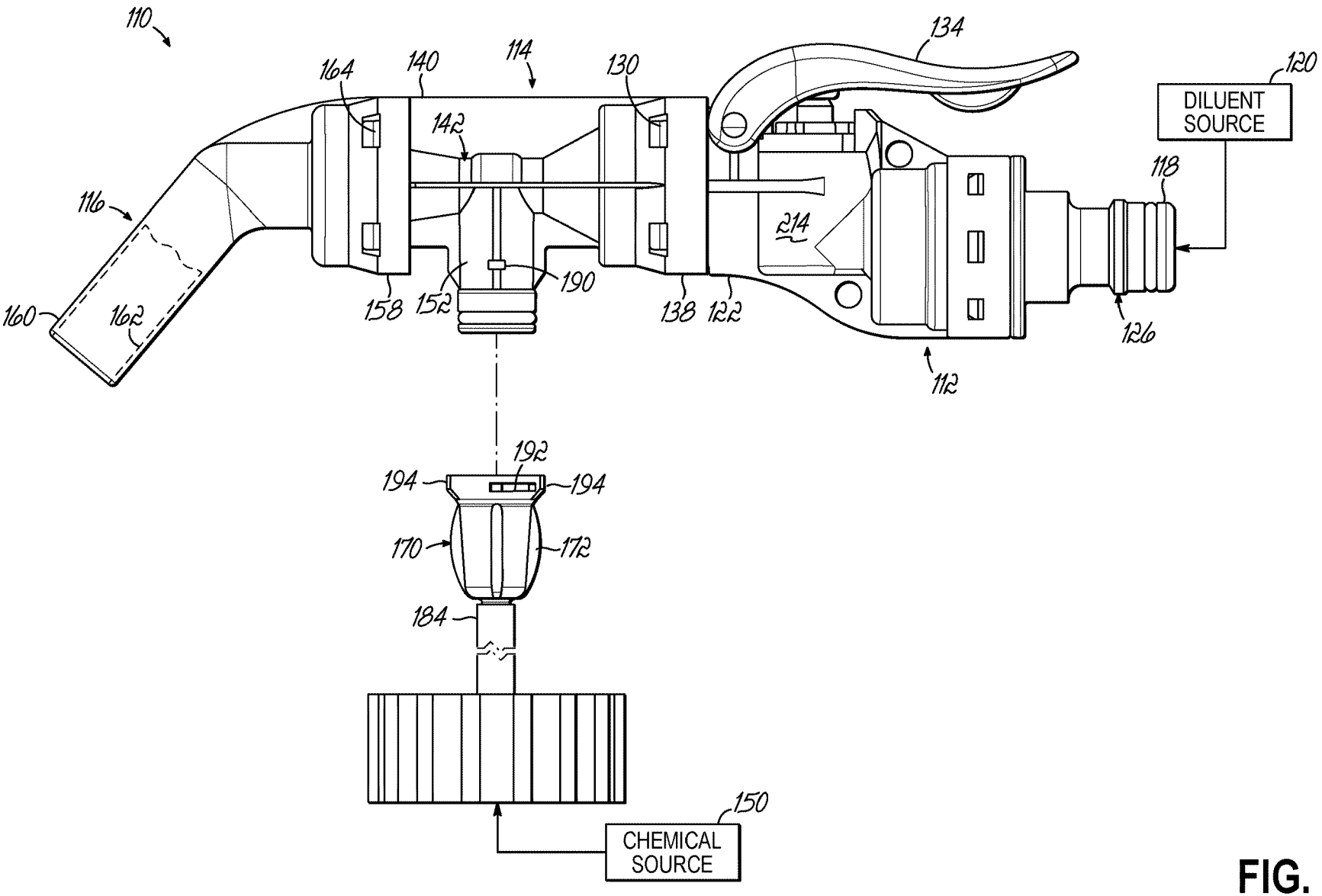
FIG. 6 illustrates a side view of a portable chemical dispenser in accordance with another embodiment of the invention.
Figure 7:
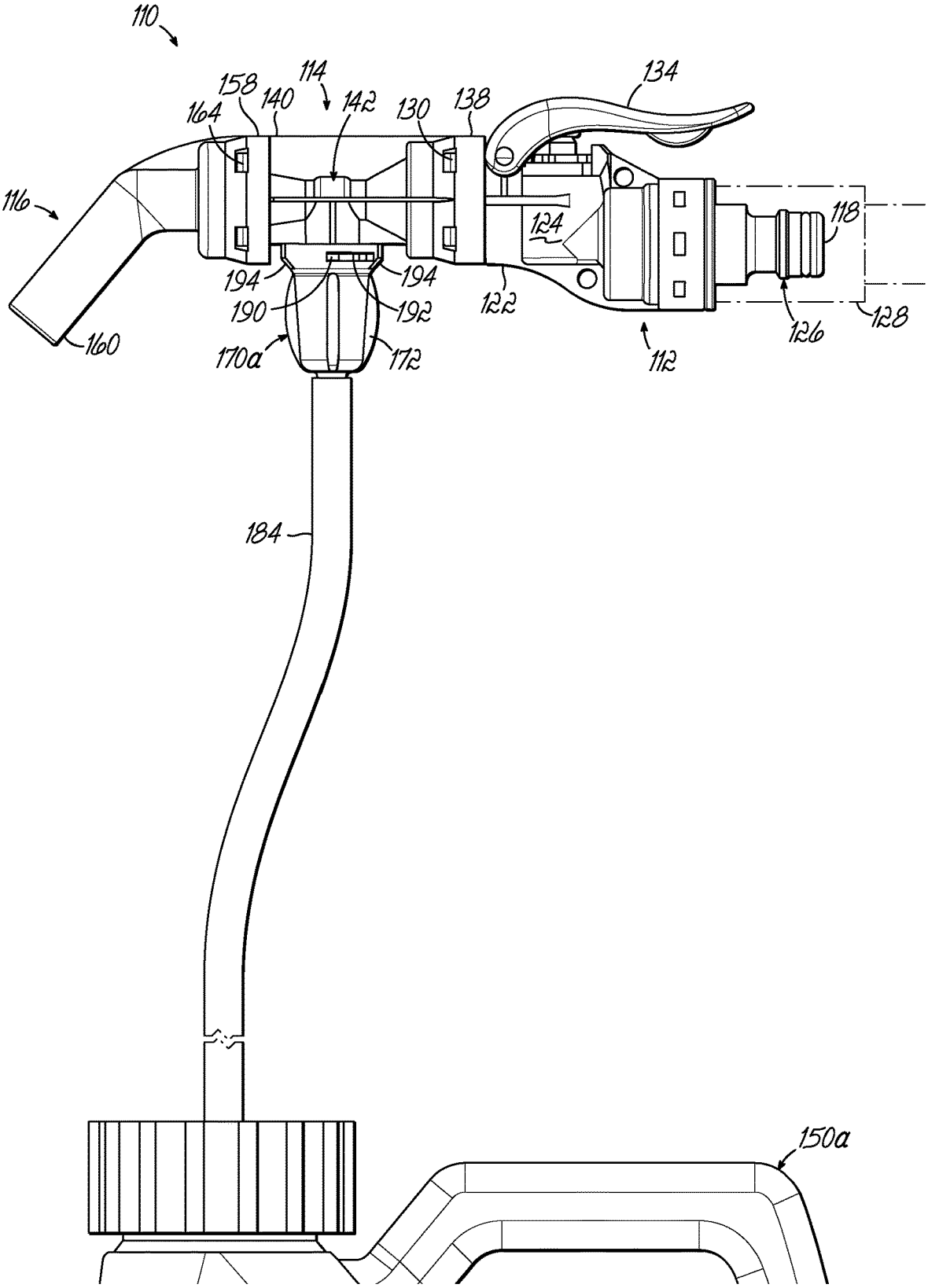
FIG. 7 illustrates the portable chemical dispenser of FIG. 6 with a cartridge associated with a chemical source.
Figure 8:
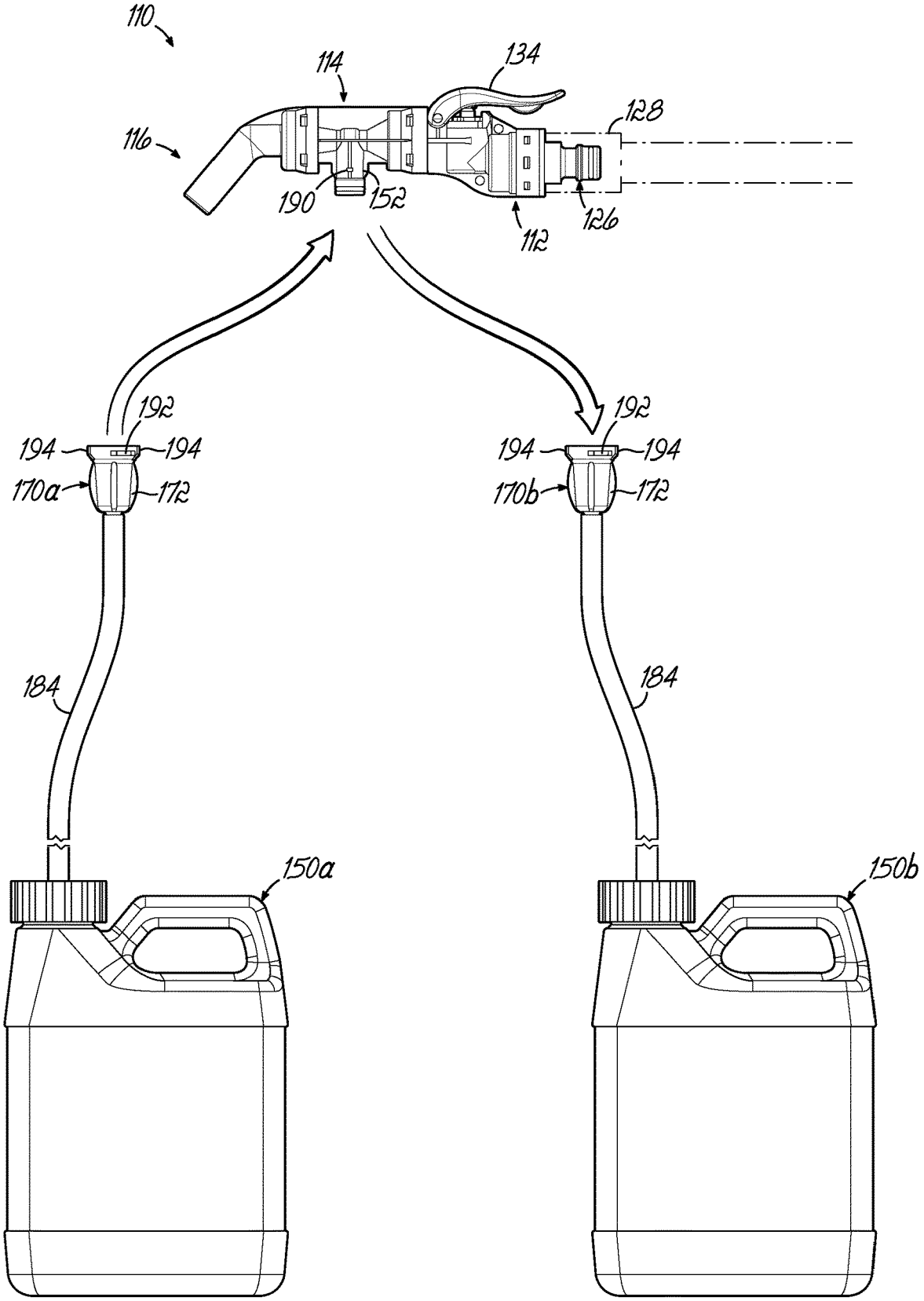
FIG. 8 illustrates the portable chemical dispenser of FIG. 6 being connectable to a plurality of chemical sources.

FIGS. 6-8 illustrate another embodiment of a portable chemical dispenser 110 in accordance with aspects of the invention. The portable chemical dispenser 110 is similar to chemical dispenser 10 described in detail above and only the differences between the dispensers will be described in any detail. Elements of the portable chemical dispenser 110 that are similar to elements of portable chemical dispenser 10 have a similar reference number but are preceded by a "1".

The primary difference between portable chemical dispensers 10 and 110 is in the construction of the eductor housing. More particularly, the eductor housing 114 of the portable chemical dispenser 110 includes only a single eductor 142 and not multiple eductors as provided by eductor housing 14 in portable chemical dispenser 10. Thus, when the diluent valve 124 is in the opened position, all the diluent flows through the single eductor 142 to draw chemical in from chemical source 150 and provide a chemical solution at a single flow rate, e.g., at a medium flow rate (e.g., 2 gallons/minute) somewhere between the high and low flow rates described above. The construction and operation of the portable chemical dispenser 110 is for all intents and purposes the same as that described above. Accordingly, one of ordinary skill in the art will understand the portable chemical dispenser 110 based on the description above and a further description will not be provided.

In one embodiment of the portable chemical dispenser 110, the valve housing 112 may remain rotatable relative to the eductor housing 114 such that the "handle" 112 may be rotatable about the longitudinal axis of the dispenser and allow an operator to press or pull the actuator 134 to dispense the chemical solution. It should be understood, however, that rotating the handle does not alter which eductor 142 the diluent flows through since the portable chemical dispenser 110 has but one eductor 142. Alternatively, the valve housing 112 may be fixed relative to the eductor housing 114 such that, for example, the actuator 134 is in an upright position (as shown) or a downturned position (not shown) in accordance with the preference of the operator.

The advantages of the portable chemical dispenser 110 are similar to those described above related to the use of a single dispenser across multiple chemical sources in an application platform, such as a janitorial platform. This aspect is most clearly demonstrated in FIG. 8, where the portable chemical dispenser 110 may first be used to dispense a first chemical from a first chemical source 150*a*, then be used to dispense a second chemical from a second chemical source 150*b*. Again, this is primarily achieved by providing cartridges 170*a*, 170*b* having the metering elements that control the dosing of the chemical and the dilution ratio of the resulting chemical solution. The cartridges 170*a*, 170*b* are configured to easily and selectively couple to the chemical inlet port 152 of the portable chemical dispenser 110 to place the chemical source 150 in communication with the eductor 142. In this way, for example, janitorial service provides do not have to purchase many portable chemical dispensers, such as one portable chemical dispenser for each chemical across the janitorial platform. Instead, janitorial service provides may only provide a single portable chemical dispenser that may be readily used to dispense multiple chemicals across the janitorial platform. Accordingly, the portable chemical dispenser 110 according to the present disclosure provides a more efficient, lower cost solution for janitorial service providers.

Figure 9:
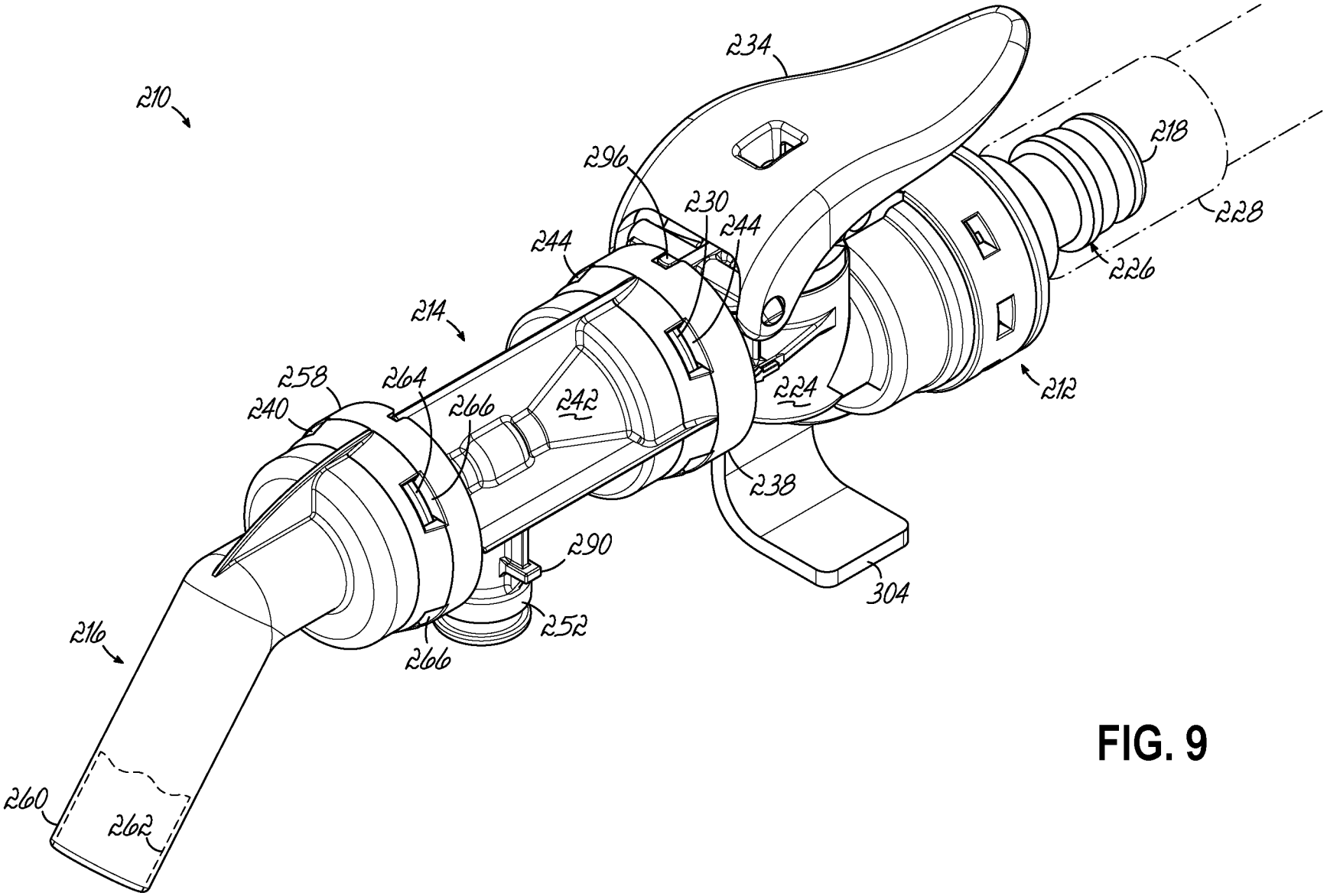
FIG. 9 illustrates a perspective view of a portable chemical dispenser in accordance with another embodiment of the invention.
Figure 10:
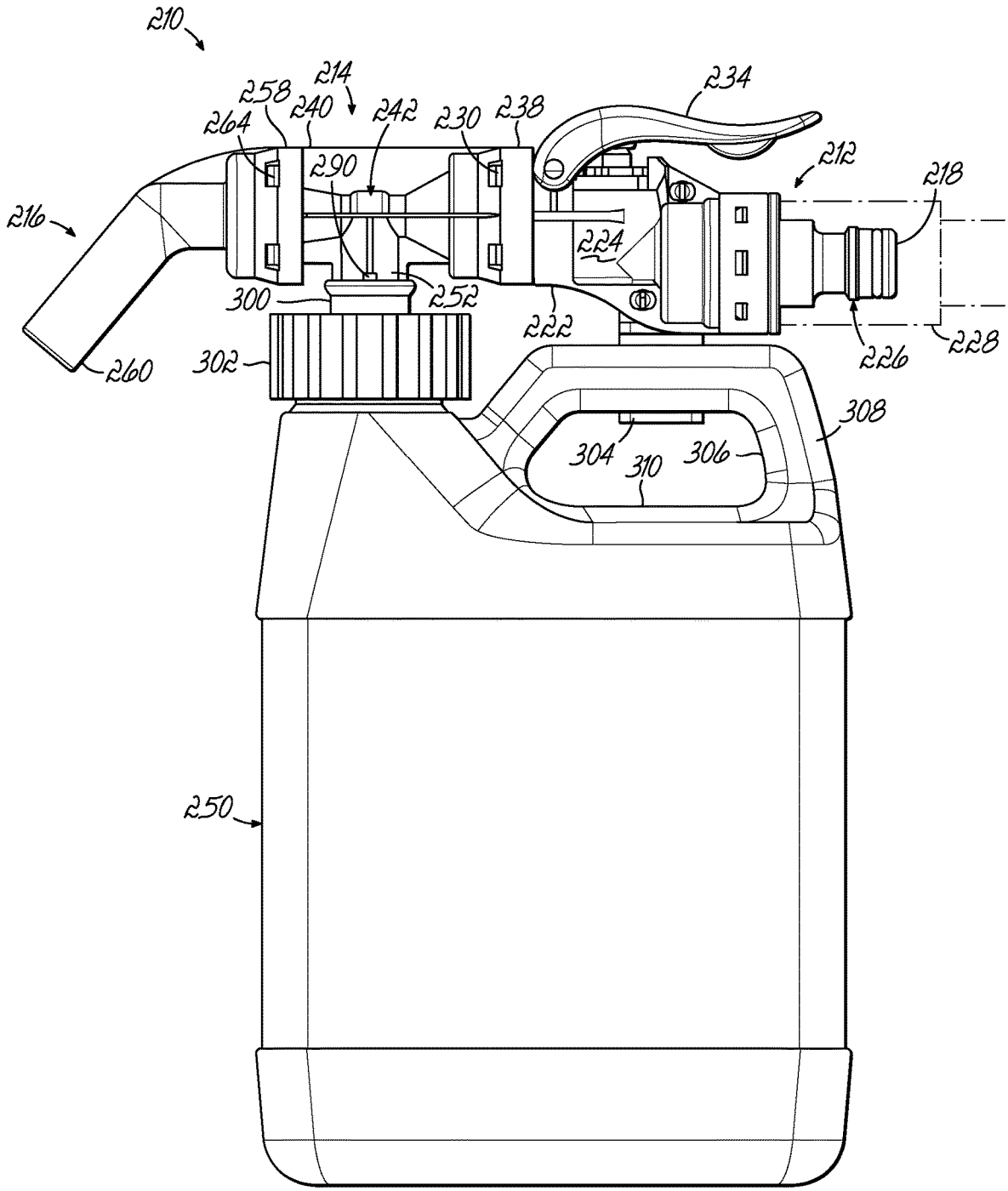
FIG. 10 illustrates the portable chemical dispenser of FIG. 9 connected to a chemical source.
Figure 11:
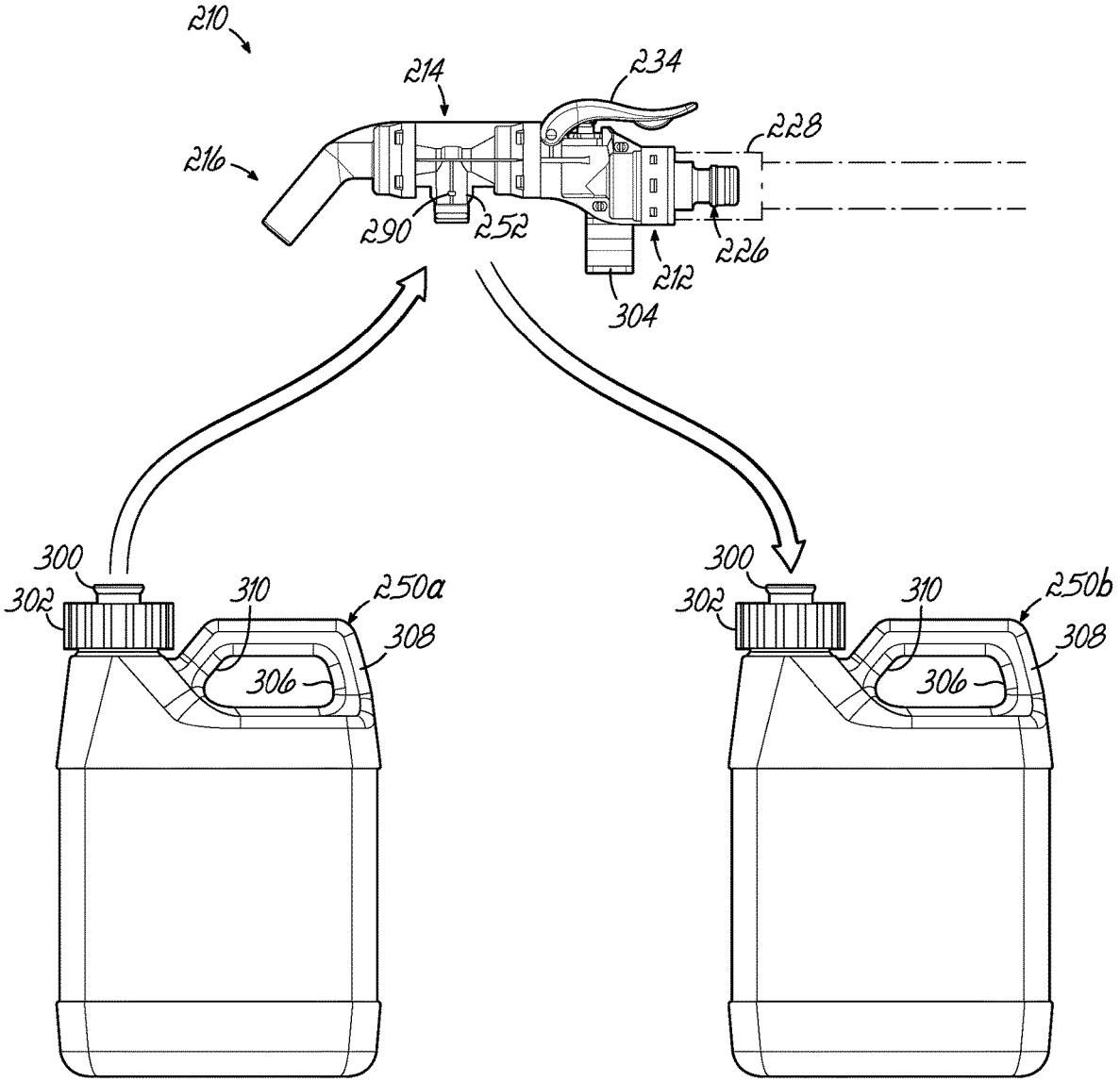
FIG. 11 illustrates the portable chemical dispenser of FIG. 6 being connectable to a plurality of chemical sources.

FIGS. 9-11 illustrate another embodiment of a portable chemical dispenser 210 in accordance with aspects of the invention. The portable chemical dispenser 210 is similar to chemical dispenser 10 described in detail above and only the differences between the dispensers will be described in any detail. Elements of the portable chemical dispenser 210 that are similar to elements of portable chemical dispenser 10 have a similar reference number but are preceded by a "2".

Similar to the portable chemical dispenser 110 described above, portable chemical dispenser 210 may include only a single eductor 242 and not multiple eductors as provided by eductor housing 14 in portable chemical dispenser 10. That difference was described above and will not be repeated here. Another difference between portable chemical dispensers 10 and 210 is in the manner in which the dispenser is operatively coupled to a chemical source. For example, in the description above, the portable chemical dispenser 10 included a chemical inlet port 52 that is configured to couple to a cartridge 70 associated with the chemical source 50 through, for example, the bayonet connection. The cartridge 70 is in turn coupled to the chemical source 50 via a length of conduit or tubing 84. In use, an operator may hold the portable chemical dispenser 10 in one hand and hold the chemical source 50 in the other hand. Thus, the portable chemical dispenser 10 and the chemical source 50 may be separated over some distance, which is traversed by a length of tubing 84 (e.g., about three feet in length).

The portable chemical dispenser 210 is configured to operate in a slightly different way. More particularly, the portable chemical dispenser 210 is configured to couple directly to an outlet port 300 on the chemical source 250. By way of example and without limitation, the outlet port 300 may be associated with a cap 302 of the chemical source 250. Thus, the chemical inlet port 252 of the portable chemical dispenser 210 may be slightly different than that described above. In this regard, the chemical inlet port 252 may include a male connector and the outlet port 300 on the chemical source 250 may include a female connector such that upon connecting the portable chemical dispenser 210 to the chemical source 250, the eductor 242 of the portable chemical dispenser 210 is in fluid communication with the chemical stored in the chemical source 250. Thus, the bayonet connection is omitted and the chemical inlet port 252 forms a fluid-tight connection with the outlet port 300 of the chemical source 300 through a slip fit.

Additionally, the portable chemical dispenser 210 is configured to be secured to the chemical source 250 such that the assembly of the portable chemical dispenser 210 and the chemical source 250 may be carried by one hand of an operator. In an exemplary embodiment, the valve housing 212 may include a clip arm 304 projecting from the valve housing 212 that is configured to engage an arm receiver 306 on the chemical source 250 for securing the portable chemical dispenser 210 and the chemical source 250 together. In one embodiment, for example, the clip arm 304 may include an L-shaped bracket that projects from a lower side of the valve housing 212 (e.g., opposite to the actuator 234) and then extends to one side of the valve housing 214. Moreover, the chemical source 250 may include a handle 308 defining an opening 310 that operates as the arm receiver 306. Thus, the portable chemical dispenser 210 is configured to clip to the handle 308 of the chemical source 250.

Furthermore, because the portable chemical dispenser 210 is configured to be coupled directly to the chemical source 250, the location of the metering elements that control the dosing of the chemical with the diluent has changed. For example, a separate cartridge 70 spaced from the chemical source 50 is omitted in this embodiment. Instead, the metering and valve elements that had previously been included in the cartridge 70 are now positioned either in the cap 302 of the chemical source 250 or in the confines of the chemical source 250 itself, such as in a neck portion of the chemical source 250, for example. In any event, the construction and operation of the portable chemical dispenser 210 is similar to that described above and one of ordinary skill in the art will understand the construction and operation of the portable chemical dispenser 210 based on the description above.

The advantages of the portable chemical dispenser 210 are similar to those described above related to the use of a single dispenser across multiple chemical sources in an application platform, such as a janitorial platform. This aspect is most clearly demonstrated in FIG. 11, where the portable chemical dispenser 210 may first be used to dispense a first chemical from a first chemical source 250*a*, then be used to dispense a second chemical from a second chemical source 250*b*. Again, this is primarily achieved by associating the metering elements that control the dosing of the chemical and the dilution ratio of the resulting chemical solution with the chemical sources 250*a*, 250*b* and not the portable chemical dispenser itself. In this way, for example, janitorial service provides do not have to purchase many portable chemical dispensers, such as one portable chemical dispenser for each chemical across the janitorial platform. Instead, janitorial service provides may only provide a single portable chemical dispenser that may be readily used to dispense multiple chemicals across the janitorial platform. Accordingly, the portable chemical dispenser 210 according to the present disclosure provides a more efficient, lower cost solution for janitorial service providers.

In the portable chemical dispenser 210 described above, the valve and metering elements for controlling the dosing of the chemical with the diluent were located within the cap 302 and/or within the neck of the chemical source 250. In various alternative embodiments, it should be understood that for chemical dispensers 10, 110 described above, the cartridges 70, 170, may be omitted and the valve and metering elements located within the cap and/or within the neck of the chemical sources 50, 150. Such embodiments remain within the scope of the present invention.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. In this regard, while the above was directed to the application of the chemical solution to a receptacle, other applications are possible. For example, the nozzle of the portable chemical dispenser may be configured as an endpiece configured to couple to various nozzles. The endpiece may be configured to couple to a foam applicator or a spray applicator for applying a chemical solution to various surfaces, such as walls, floors and/or ceilings. According, it should be understood that the various features of the invention may be used alone or in numerous combinations depending on the needs and preferences of the user.

What is claimed is:

1. A portable chemical dispenser for dispensing a chemical with a diluent, comprising:

a valve housing having a diluent valve with an opened position and a closed position, wherein diluent is configured to flow through the portable chemical dispenser when the diluent valve is in the opened position and diluent is prevented from flowing through the portable chemical dispenser when the diluent valve is in the closed position;

an eductor housing coupled to the valve housing and including a plurality of eductors, wherein the eductor housing includes a chemical inlet port configured to be coupled to a chemical source storing the chemical; and a nozzle coupled to the eductor housing and configured to direct the flow of a chemical solution to a receptacle, wherein a connection between the valve housing and the eductor housing permits the valve housing to rotate into respective positions that place an outlet of the valve housing in communication with a respective one of the plurality of eductors, and wherein the connection is configured such that the eductor housing remains stationary during a rotation of the valve housing.

2. The portable chemical dispenser of claim 1, wherein the connection between the valve housing and the eductor housing permits the valve housing to rotate relative to the eductor housing about a longitudinal axis of the portable chemical dispenser.

3. The portable chemical dispenser of claim 1, wherein the eductor housing includes a first eductor and a second eductor, of the plurality of eductors, and wherein the valve housing is rotatable relative to the eductor housing between a first position that permits the diluent to be in fluid communication with the first eductor, and a second position that permits the diluent to be in fluid communication with the second eductor.

4. The portable chemical dispenser of claim 3, wherein the valve housing includes an actuator, wherein the actuator is in a first position in the first position of the valve housing and the actuator is in a second position in the second position of the valve housing.

5. The portable chemical dispenser of claim 4, wherein the first and second positions of the valve housing relative to the eductor housing are offset by 180 degrees.

6. The portable chemical dispenser of claim 1, wherein the portable chemical dispenser is devoid of metering elements that control the dosing of the chemical with the diluent.

7. A method of dispensing a plurality of chemicals from respective chemical sources using a diluent, comprising:

providing the portable chemical dispenser of claim 1, the portable chemical dispenser being devoid of any metering elements that control a dosing of the chemical with the diluent;

connecting the portable chemical dispenser with a first chemical source storing a first chemical;

dispensing the first chemical using the portable chemical dispenser;

disconnecting the portable chemical dispenser from the first chemical source;

connecting the portable chemical dispenser with a second chemical source storing a second chemical; and dispensing the second chemical using the portable chemical dispenser.

8. The method of claim 7, wherein the first and second chemicals are dispensed at the same or different dilution ratios.

9. The method of claim 7, wherein the first and second chemicals may be dispensed at two different flow rates by the portable chemical dispenser.

10. The method of claim 7, wherein connecting the portable chemical dispenser with the first chemical source further comprises connecting the portable chemical dispenser with a first cartridge associated with the first chemical source, the first cartridge containing metering elements that control the dosing of the first chemical with the diluent.

11. The method of claim 10, wherein the first cartridge is separated from the first chemical source and is operatively coupled to the first chemical source by tubing.

12. The method of claim 10, wherein the first cartridge is positioned within a cap or within the confines of the first chemical source.

13. The method of claim 12, wherein the portable chemical dispenser is clipped to the first chemical source.

14. The method of claim 7, wherein connecting the portable chemical dispenser with the second chemical source further comprises connecting the portable chemical dispenser with a second cartridge associated with the second chemical source, the second cartridge containing metering elements that control the dosing of the second chemical with the diluent.

15. The method of claim 14, wherein the second cartridge is separated from the second chemical source and is operatively coupled to the second chemical source by tubing.

16. The method of claim 14, wherein the second cartridge is positioned within a cap or within the confines of the second chemical source.

17. The method of claim 16, wherein the portable chemical dispenser is clipped to the second chemical source.

* * * * *